US009073112B2

(12) United States Patent
Cole et al.

(10) Patent No.: US 9,073,112 B2
(45) Date of Patent: Jul. 7, 2015

(54) SYSTEM AND METHOD FOR DETERMINING PRESS PARAMETER INPUTS IN A DRAW DIE PROCESS

(75) Inventors: Trevor M. Cole, Wyandotte, MI (US); Jason A. Ryska, Milford, MI (US); Lance J. Schwartz, Washington Township, MI (US)

(73) Assignee: FCA US LLC, Auburn Hills, MI (US)

( * ) Notice: Subject to any disclaimer, the term of this patent is extended or adjusted under 35 U.S.C. 154(b) by 798 days.

(21) Appl. No.: 13/409,618

(22) Filed: Mar. 1, 2012

(65) Prior Publication Data

US 2013/0231770 A1 Sep. 5, 2013

(51) Int. Cl.
*B21D 22/02* (2006.01)
*B21D 22/20* (2006.01)

(52) U.S. Cl.
CPC ..... *B21D 22/02* (2013.01); *B21D 22/20* (2013.01)

(58) Field of Classification Search
None
See application file for complete search history.

(56) References Cited

U.S. PATENT DOCUMENTS

| | | | | |
|---|---|---|---|---|
| 5,450,347 | A | 9/1995 | Thoms et al. | |
| 6,751,572 | B1 * | 6/2004 | Modesto et al. | 702/155 |
| 7,418,309 | B2 * | 8/2008 | Asher, Jr. | 700/165 |
| 2007/0067060 | A1 * | 3/2007 | Tateno | 700/165 |
| 2007/0240470 | A1 | 10/2007 | Suzuki et al. | |

* cited by examiner

*Primary Examiner* — Ryan Jarrett
(74) *Attorney, Agent, or Firm* — Ralph E Smith

(57) ABSTRACT

A method and system for controlling the draw die process is disclosed. The system includes a parameter database that stores a plurality of press parameter combinations and an associated probability of a successful draw die process given the press parameter combination and a set of mechanical properties. The system includes a parameter determination module that receives mechanical properties of a blank to be drawn, and selects a parameter combination based on the mechanical properties and the probability of success. The selected press parameter combination is used in the draw die process. A feedback module receives the results of the draw die process and updates the probability of success or failure of a draw die process associated with the selected press parameter combination based on the results.

20 Claims, 5 Drawing Sheets

SYSTEM AND METHOD FOR DETERMINING PRESS PARAMETER INPUTS IN A DRAW DIE PROCESS

FIELD

The present invention relates to a system and method for determining stamping system parameter inputs in a draw die process.

BACKGROUND

Stamping is the process by which a metal blank ("blank") is formed into a part. A die draw system is used to form or "stamp" a metal blank into a part that is used for forming, for example, a panel of a vehicle. The draw die process is the first forming operation in the stamping process and the most critical operation in forming the part. It is estimated that 70% of all failures in the stamping process occur in the draw die process. A failure can occur, for example, if the blank is stretched too thin or if not enough pressure is applied to the blank when the draw die process is performed.

To better control the draw die process, a layer of lubrication may be applied to the blank prior to the draw die process. The lubrication is applied to reduce the friction between the blank and the press of the die draw system. If too much lubrication is applied to the blank the amount of strain in the blank will increase, thereby resulting in failure. If too little lubrication is applied to the blank, the amount of strain in the blank will buckle or wrinkle thereby resulting in failure. Similarly, the amount of cushion that is applied at the binders effects the draw die process. If the amount of cushion tonnage at the binders is too great, the amount of strain in the blank increases past the ultimate tensile strength of the blank, thereby resulting in a thinning failure. If the amount of cushion tonnage at the binders is too great, the amount of strain in the blank decreases and does not reach the yield strength, thereby resulting in an insufficient thinning failure.

SUMMARY

In one aspect of the disclosure, a control module for controlling a draw die process is disclosed. The control module includes a press parameter database that stores a plurality of press parameter combinations corresponding to a plurality of different mechanical properties of materials. Each one of the plurality of different mechanical properties has at least one press parameter combination corresponding thereto, and each specific press parameter combination of the plurality of press parameter combinations has associated thereto a probability of one of a successful draw die process and a failed draw die process given the specific press parameter combination and the one of the different mechanical properties corresponding to the specific press parameter combination. The control module further comprises a parameter determination module that receives mechanical properties corresponding to a plurality of blanks that are to undergo the draw die process and retrieves a press parameter combination based on the received mechanical properties and a probability associated with the retrieved press parameter combination. The probability is indicative of a likelihood of one of a successful draw die process and a failed draw die process given the retrieved press parameter combination and the received mechanical properties. The parameter determination module is further configured to provide the retrieved press parameter combination to a draw die system that performs a first draw die process on a first blank from the plurality of blanks. The control module further comprises a feedback module that receives a result of the first draw die process, determines whether the first draw die process resulted in failure or in success, and adjusts the probability associated to the retrieved press parameter combination based on the whether the first draw die process resulted in failure or in success.

In another aspect of the disclosure, a method for controlling a draw die process is disclosed. The method comprises storing a plurality of press parameter combinations corresponding to a plurality of different mechanical properties of materials in a parameter database. Each one of the plurality of different mechanical properties has at least one press parameter combination corresponding thereto, and each specific press parameter combination of the plurality of press parameter combinations has associated thereto a probability of one of a successful draw die process and a failed draw die process given the specific press parameter combination and the one of the different mechanical properties corresponding to the specific press parameter combination. The method further comprises receiving mechanical properties corresponding to a plurality of blanks that are to undergo the draw die process, and retrieving a press parameter combination based on the received mechanical properties and a probability associated with the retrieved press parameter combination. The probability is indicative of a likelihood of one of a successful draw die process and a failed draw die process given the retrieved press parameter combination and the received mechanical properties. The method further comprises providing the retrieved press parameter combination to a draw die system that performs a first draw die process on a first blank from the plurality of blanks, receiving a result of the first draw die process, determining whether the first draw die process resulted in failure or in success; and adjusting the probability associated to the retrieved press parameter combination based on whether the first draw die process resulted in failure or in success.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application, or use. Thus, variations that do not depart from the gist of the invention are intended to be within the scope of the invention.

DETAILED DESCRIPTION

In order to reduce failures in the die draw die process, a control module is described that receives mechanical properties of a blank and determines a lubrication parameter value and a cushion parameter value for application during the die draw die process, collectively referred to as a "press parameter combination." The mechanical properties of a blank may include one or more of an n-value n, the material thickness t, a yield strength $y_s$, a tensile strength $t_s$, and a strain value ΔL/L. The system receives the mechanical properties and determines the press parameters, which are provided to a die draw system. The die draw system performs the draw die process, which is monitored for failure by a sensor and/or a human. The results are provided to the control module which updates one or both of the press parameters to compensate for an observed failure. If the die draw die process is successful, the press parameter combination is affirmed.

Figure 1:
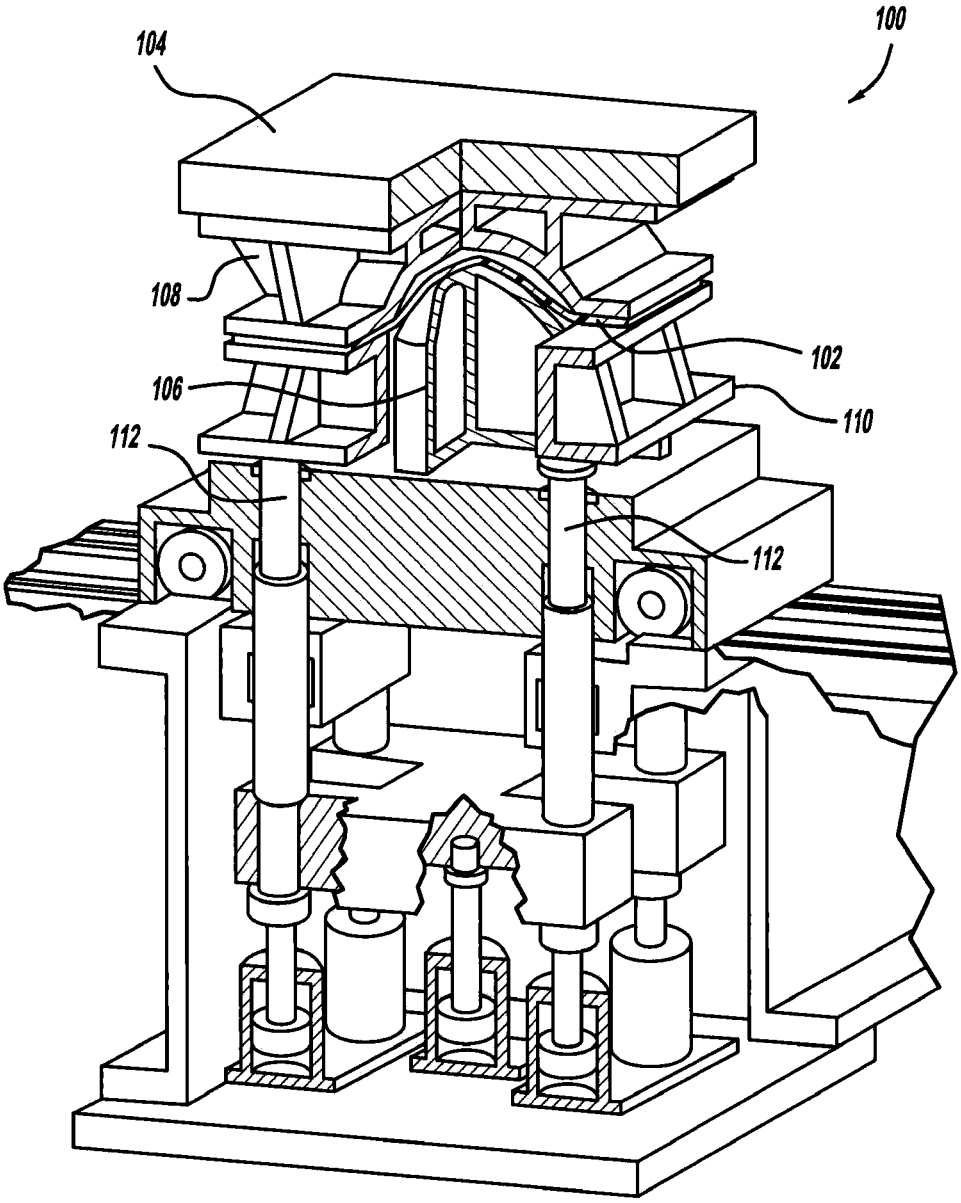
FIG. 1 is a drawing illustrating a draw die apparatus according to the prior art.

FIG. 1 illustrates an exemplary die draw system 100. The die draw system 100 described is provided for context only and not intended to be limiting. The die draw system 100 includes a press 104, a punch 106, a die 108, a binder 110, and one or more pressure columns 112. The die draw system 100 performs stamping operations on a metal blank 102 or blank 102. The die 108 is connected to the press 104. The blank 102 is inserted in between the die 108 and the punch 106. The press 104 applies a downward force to the die 108, which forcibly presses against the blank 102. The blank 102, as the force is applied thereto, stretches around the punch 106, thereby forming the blank 102. The blank 102 is held in place by the binder 110. The binder 110 is supported by the pressure columns 112. The pressure columns 112 can be hydraulic columns having an adjustable cushion tonnage, such that the amount of force required to completely compress the pressure columns 112 is adjustable.

The amount of force required to completely compress the pressure columns 112 is referred to as the cushion tonnage. The cushion tonnage of the pressure columns 112 corresponds to the amount of force gripping the blank 102 at the binder 110. As discussed above, the cushion tonnage is a parameter that can affect whether a blank is successfully or unsuccessfully drawn.

In operation, the blank 102 is coated with a lubricant to reduce the friction between the blank 102 and the die 108 and punch 106. A blank reoiler (not shown) will apply lubricant to the blank 102 before a draw die process is performed on the blank 102 The amount of lubricant that is applied to the blank 102 is adjustable. The amount of lubricant that is applied to the blank 102 is measured in $mg/f^2$.

Once the blank 102 is coated with lubricant, the blank 102 is inserted between the die 108 and the punch 106. The press 104 forces the die 108 downwardly and restrains the blank 102 at the outer edge of the blank 102. The press 104 continues to force the die 108 downwardly, thereby stretching the blank 102 around the punch 106. As was discussed above, the pressure columns 112 will have a cushion tonnage setting, thereby controlling how much force is required to fully compress the pressure columns 112. The press 104 applies a press tonnage in the downward direction. The press tonnage is typically a constant. Once the press 104 has completed applying the downward force, the press 104 is lifted, and the die draw die process is complete.

Depending on the mechanical properties of the blank 102, the amount of lubrication applied to the blank 102, the cushion tonnage of the pressure columns, and the press tonnage exerted on the blank 102, the blank may be either successfully formed or unsuccessfully formed, i.e., a failed draw. A failed draw can result from either the blank 102 thinning or the blank 102 buckling, i.e., insufficient thinning.

Figure 2:
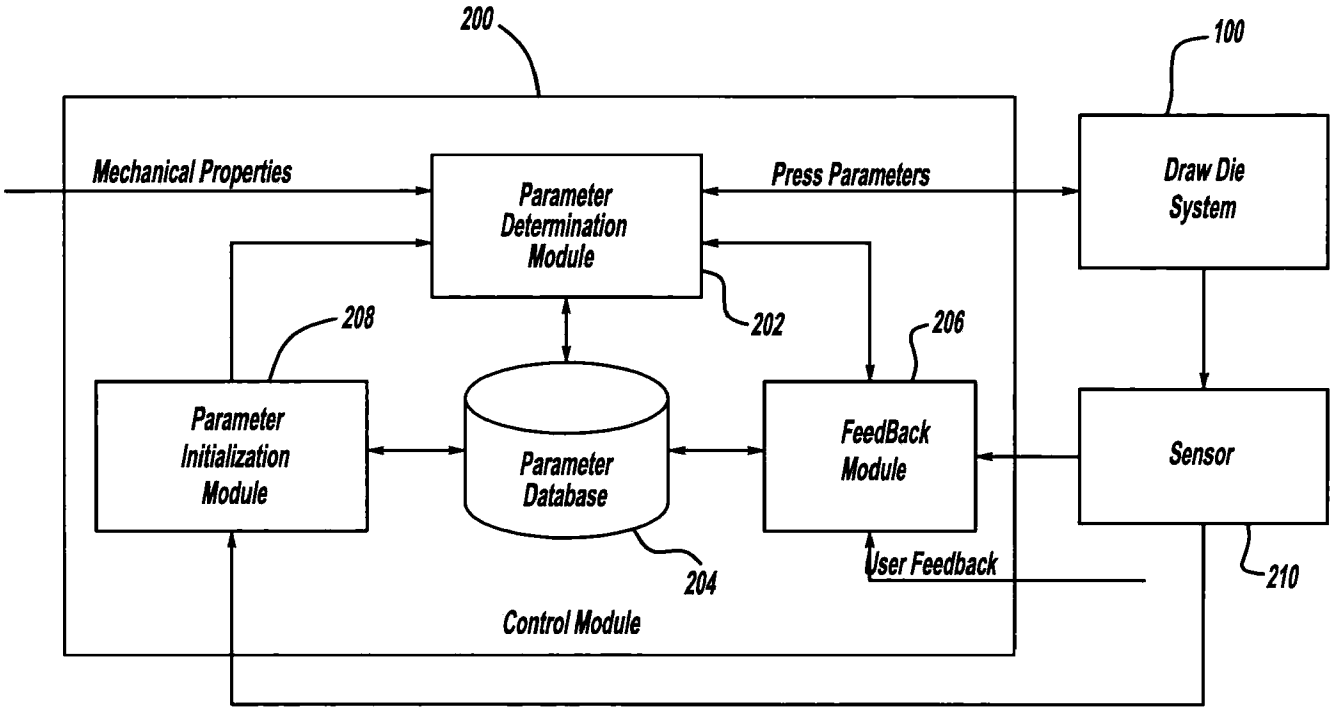
FIG. 2 is a block diagram illustrating a control module that controls a draw die system according to some embodiments of the invention.

FIG. 2 illustrates an exemplary draw die system 100 controlled by a control module 200. The control module 200 is comprised of a parameter determination module 202, a parameter database 204, a feedback module 206, and a parameter initialization module 208.

The parameter determination module 202 receives the mechanical properties of a blank 102 or set of blanks 102 and determines a press parameter combination based on the mechanical properties. The parameter determination module 202 can determine a lubrication parameter value and a cushion parameter value. The lubrication parameter value indicates an amount of lubrication to apply to a blank 102 before the draw die process. The cushion parameter value indicates a cushion tonnage setting for the pressure columns 112. The parameter determination module 202 retrieves the press parameter combination from the parameter database 204 based on the mechanical properties of the blank and a probability of a successful draw die process associated with the press parameter combination. The parameter determination module 202 transmits one or more signals to the die draw system 100 indicating the press parameter values. The die draw system 100 receives the press parameter values and adjusts the settings of the reoiler and the pressure columns 112 in accordance with the press parameter combination.

Figure 3:
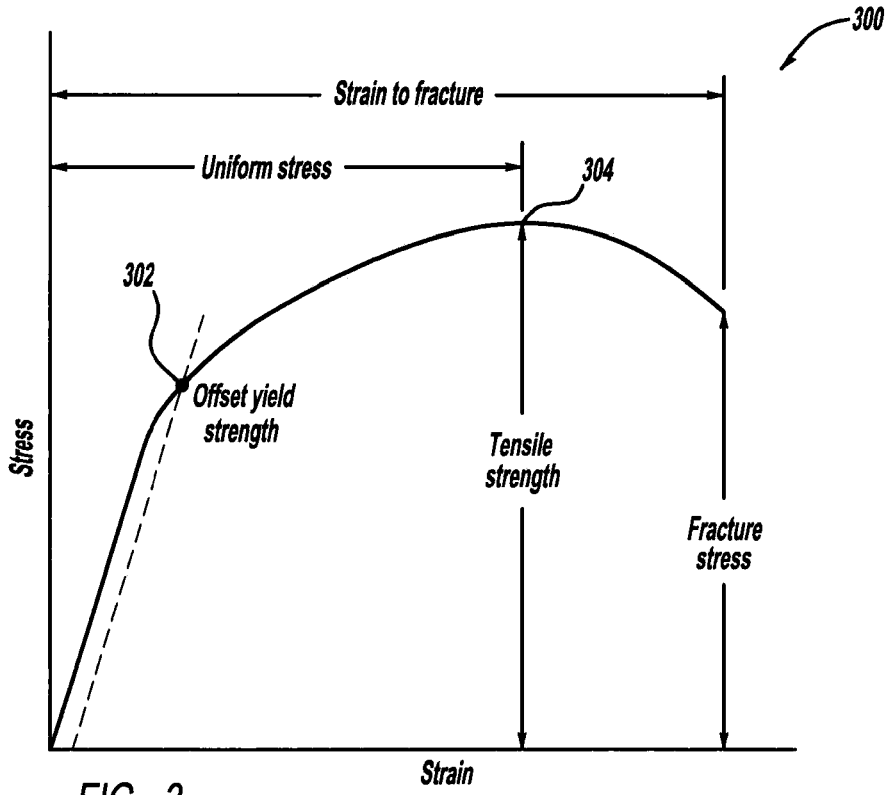
FIG. 3 is a graph illustrating a stress strain curve.

As discussed above, the mechanical properties include one or more of an n-value n, the material thickness t, a yield strength $y_s$, a tensile strength $t_s$, and a strain value ΔL/L. Typically, a plurality of blanks 102 are received from a material manufacturer. The mechanical properties may be provided by the material manufacturer for the plurality of blanks 102. Because of variation from blank 102 to blank 102 in the received plurality, the manufacturer will provide the mechanical properties in ranges. For instance, the material manufacturer may provide a range of material thicknesses, and a range of n-values. The n-values describe the relationship between the yield strength and the tensile strength of a blank 102. FIG. 3 illustrates an exemplary stress strain curve 300. The stress-strain curve shows the tensile strength and the yield strength of a blank 102. As the amount of strain that is applied to the blank is increased, the blank 102 will initially be in an "elastic" range. In the elastic range, the blank 102 will return to its original shape when the force applied to it is removed. The yield strength point 302 on the curve 300 defines the amount of force that must be applied to the blank 102 such that the blank 102 will not return to its original shape. The tensile strength point 304 on the curve 300 defines the amount of force that can be applied to the blank 102 where thinning is first observed. Once excessive thinning or insufficient thinning is observed, the blank 102 is said to have failed. The terminal n-value defines the relationship between the yield strength of a particular blank 102 and the tensile strength of the particular blank 102. As can be appreciated, as a plurality of blanks 102 are received, the n-value may be provided or calculated as a range, such that an upper n-value $n_{max}$, a lower n-value $n_{min}$, and a mean n-value $n_{\bar{x}}$ may be provided by the material manufacturer or may be calculated by the material uniform elongation, which is exhibited between yield strength and tensile strength. Similarly, a range of thicknesses t can be obtained from the manufacturer or measured, such that a $t_{max}$, $t_{min}$, and $t_{\bar{x}}$ are determined.

The parameter database 204 stores press parameter combinations as a function of the mechanical properties values. As will be discussed below, the press parameters, i.e., lubrication parameter values and cushion parameter values, are initially determined by the parameter initialization module 208 during an experimental phase, and iteratively updated during successive draw die processes by the feedback module 206 to compensate for failed draws. The parameter database 204 may also be organized to associate a probability of success for a press parameter combination corresponding to a specific set of mechanical properties. The parameter determination module 202, knowing the mechanical properties of the blank 102, will select the press parameter combination that is the most likely to result in a successful draw.

The parameter initialization module 208 determines an initial press parameter combination for blanks 102 having different mechanical properties. As can be appreciated, different sets of blanks 102 may have varying thickness ranges and n-values. Thus, the parameter initialization module 208 determines initial lubrication parameter values and initial cushion parameter values for a plurality of different mechanical property values. The parameter initialization module 208 is executed during a controlled experimentation phase. It is appreciated that a sensor 210 may be used to determine an output strain of a blank 102 after the draw die process. The sensor 210 may measure the output strain at critical areas of the blank 102 after the draw die process has been performed. The sensor provides the output strains to the parameter initialization module 208. The parameter initialization module 208 uses the output strains to determine combinations of press parameters that result in successful draw die processes and combinations of press parameters that result in failed draw die processes.

In some embodiments, the parameter initialization module 208 is configured to perform the Taguchi method to determine the relationship between the mechanical properties, lubrication thickness, and cushion tonnage and the effects thereof on the draw die process. It is appreciated that the parameter initialization module 208 can further use the results obtained during the Taguchi method to build up training data that can be stored in the parameter database 204 and can be later used for determining press parameters.

During the controlled experimentation phase, the parameter initialization module 208 can, for a set of blanks 102 having the same mechanical properties, instruct the parameter determination module 202 to set the lubrication parameter value and cushion parameter value at different values to determine the effect that each variable has on the draw die process. For example, the parameter initialization module 208 will instruct the parameter determination module 202 to perform the draw die process on the set of blanks at a minimum lubrication parameter value, e.g., 80 mg/ft$^2$, a maximum lubrication parameter value, e.g., 250 mg/ft$^2$, and a mean lubrication parameter value, while holding the cushion parameter value constant at a minimum cushion parameter value. The parameter initialization module 208 can then instruct the parameter determination module 202 to perform the draw die process on the set of blanks at the minimum lubrication parameter value, the maximum lubrication parameter value, and the mean lubrication parameter value, while holding the cushion parameter value constant at a maximum cushion parameter value. The parameter initialization module 208 can also instruct the parameter determination module 202 to perform the draw die process on the set of blanks at the minimum lubrication parameter value, the maximum lubrication parameter value, and the mean lubrication parameter value, while holding the cushion parameter value constant at a mean cushion parameter value.

It is appreciated, that in the foregoing example, a plurality of tests, e.g., nine, are run at the different combinations of lubrication parameter values and cushion parameter values. It is appreciated that tests at other combinations of cushion parameter values and lubrication parameter values can be performed. After each test, the sensor 210 can provide an output strain corresponding to the test. The results of the tests, i.e., the output strains, can be processed by the parameter initialization module 208 to generate a forming limit curve (FLC).

Figure 4:
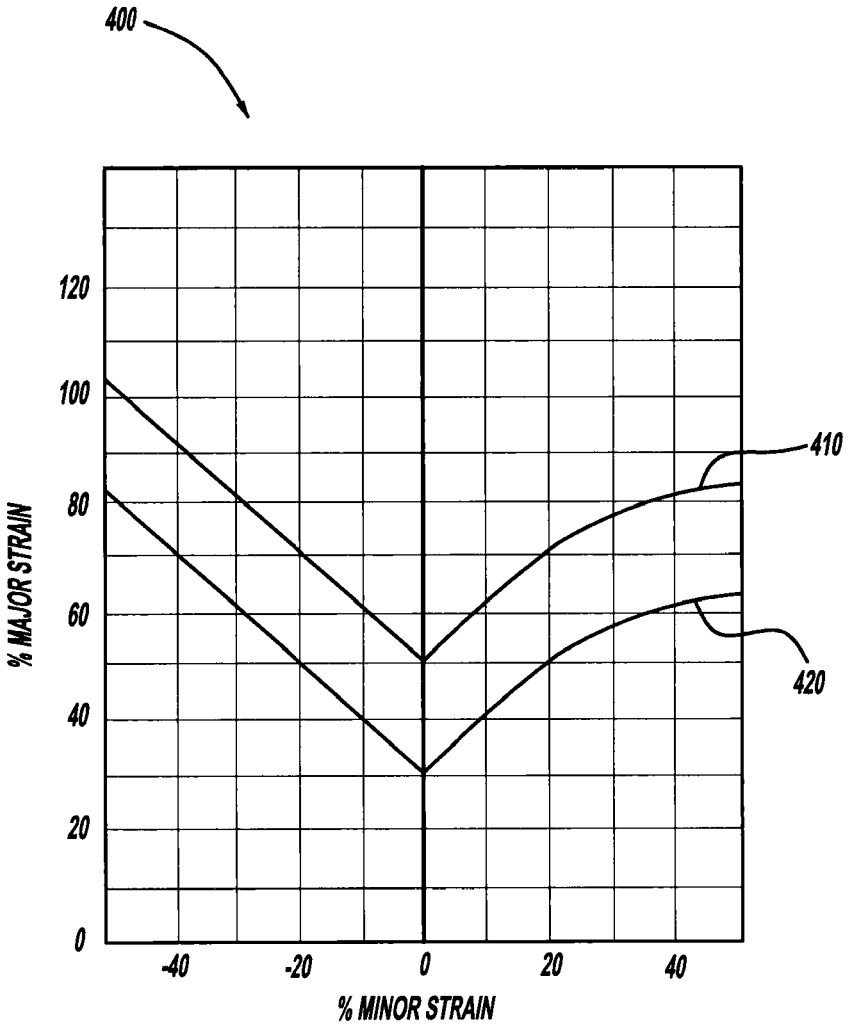
FIG. 4 is a graph illustrating a forming limit (FLC) curve.

FIG. 4 illustrates an exemplary FLC 400. The FLC 400 may define a lower limit 420 and an upper limit 410 of allowable amounts of strain or thinning in the draw-die process. The upper limit 410 can be provided by the material manufacturer of the blanks. The manufacturer of the blanks can determine the upper limit 410 of the FLC 400 using the Keeler Brazier method. For instance, the FLC curve may be calculated according to the following:

$$FLC_0^{true} = \ln(1 + (0.233 + 0.1413t)\frac{n}{0.21}$$

For $\varepsilon_2 < 0$, $$\varepsilon_1 = FLC_0^{true} - \varepsilon_2$$

For $\varepsilon_2 > 0$ $$\varepsilon_1 = \ln(0.6(\exp(\varepsilon_2) - 1) + \exp(FLC_0^{true}))$$

where $\epsilon_2$ is the minor strain, and $\epsilon_1$ is the major strain and a function of $\epsilon_2$. As should be appreciated, if the minor strain is negative, the major strain can be determined using the linear function provided above and if the minor strain is positive, the major strain can be determined using the non-linear function provided above. $FLC_0^{true}$ is the major strain value when the minor strain is equal to 0. It is appreciated that the upper limit 410 may be subsequently lowered depending on the desired draw die process. The lower limit 420 can be defined by an offset value from the upper limit 410. The offset value can be dependent on geometry of a part that results from the draw die process. Furthermore, the offset value can be determined during the experimental phase described above.

Based on the test results and the FLC 400 for each set of mechanical properties, the parameter initialization module 208 determines the initial press parameters for each set of mechanical properties, i.e., the initial lubrication parameter values and the initial cushion parameter values for each set of mechanical properties. The initial lubrication parameter values and the initial cushion parameter values for each set of mechanical properties are stored in the parameter database 204. The FLC 400 provides the criteria necessary for optimal thinning analysis. The analysis can be performed in comprehension of uni-axial (negative minor strain) or bi-axial strain (positive minor strain). The foregoing process can enable press parameters to accept a greater amount of strain (thinning) as material n-values of properties increase.

After the initial press parameter combinations have been determined, the parameter determination module 202 can use the press parameter combinations to control the die draw die process. As can be appreciated, however, there are other variables that are, for example, non-quantifiable, difficult to measure, or difficult to gauge their affect on the draw die process. These variables may be referred to as unmeasured variables. Because of the unmeasured variables, press parameter combinations corresponding to mechanical properties that result in success for one blank 102, may result in a failed draw for another blank 102. Examples of unmeasured variables are the temperature of the die 108 or the amount of friction at the surface of the blank 102 or die 108. As can be appreciated, it is not feasible to measure the temperature of the die 108 because thermocouples are not typically placed in such objects and the die 108 is a heat sink. Similarly, it is very difficult to determine the variation of friction from blank 102 to blank 102.

The feedback module 206 monitors the results of each draw die process performed on a blank 102 to determine whether the draw die process was successful or resulted in failure. The feedback module 206 receives feedback for a draw die process from one or more sensors 210. As described above, a sensor 210 may measure strain or thinning measurements at one or more critical areas of the blank 102 after the draw die process. Any suitable sensor 210 may be used to measure strain, e.g. excessive or insufficient thinning. If the draw die process was successful the feedback module 206 affirms the press parameters used to perform the successful draw die process. If the draw die process is unsuccessful the feedback module 206 records the failure in relation to the press parameters. Furthermore, the feedback module 206 can be configured to notify the parameter determination module 202 of a successful and/or failed draw die process.

In some embodiments, the feedback module 206 implements a neural network to account for the unmeasured variables. The feedback module 206 receives feedback signals from the at least one sensor 210. For example, the feedback module 206 may receive a strain measurement from the sensor 210 corresponding to a measured strain at the one or more critical areas of the blank 102. The feedback module 206 can compare the measured thinning against the FLD curve 400 or against a predefined threshold. If the amount of thinning exceeds the upper limit 410 of the FLD curve 400, then the draw die process is considered failed due to excessive thinning. The feedback module 206 can notify the parameter determination module 202 of the failure and update the parameter database 204 to indicate that the particular combination of press parameters used in the draw resulted in failure. Similarly, the feedback module 206 can compare the strain measurement with a lower limit 420 of the FLC curve 400 to determine if insufficient thinning has occurred. If the amount of thinning is below the minimum threshold, then the draw die process can be considered to have failed due to insufficient thinning. The feedback module 206 can notify the parameter determination module 202 of the failure and update the parameter database 204 to indicate that the particular combination of press parameters used in the draw resulted in failure.

Figure 5:
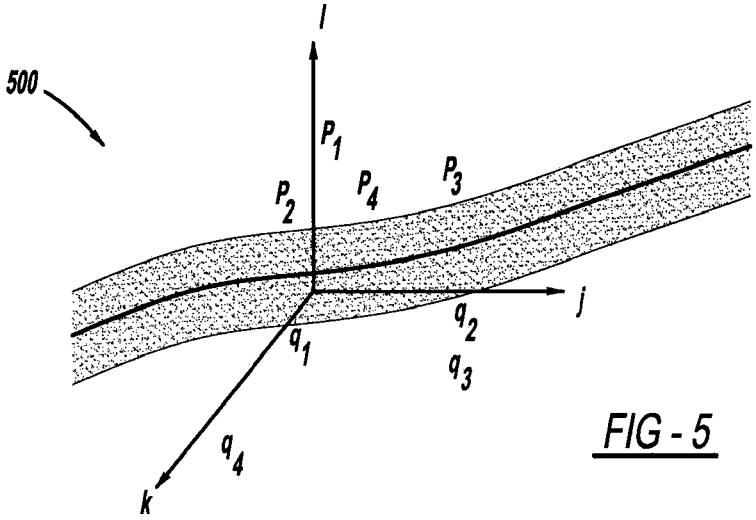
FIG. 5 is a graph illustrating a plurality of points corresponding to press parameters and mechanical properties corresponding to successful draw die processes in relation a plurality of points corresponding to press parameters and mechanical properties corresponding to failed draw die processes.

As can be appreciated from the foregoing, a neural network can be implemented where successful and failed draws can be recorded, such that the neural network can reduce failures in successive draw die processes. The neural network can maintain two classes, a class p and a class q, which can be represented by:

$$\text{Class_p} = \begin{cases} p_1 \\ p_2 \\ p_3 \\ \dots \\ p_m \end{cases} \quad \text{Class_q} = \begin{cases} q_1 \\ q_2 \\ q_3 \\ \dots \\ q_n \end{cases}$$

where m is the number of members in class p and n is the number of members in class q. Class p represents the successful draw die processes and class q represents the failed draw die processes. For each member of classes p and q, the mechanical properties, the lubrication parameter values, and the cushion tonnage parameter values are recorded. The sets p and q can be graphed, as shown in FIG. 5. FIG. 5 illustrates a graph 500 showing the relationship between the successful draw die processes and the unsuccessful draw die processes. The graph can be used to optimize the press parameter selections.

Using the sets p and q, the feedback module 206 can determine a probability of success for different combinations of press parameters. For a unique combination of press parameters, a probability of success (or probability of failure) can be determined based on the amount of times the unique combination has resulted in a successful draw die process, and how many times the unique combination resulted in an unsuccessful draw die process. Each time a unique combination of press parameters is used to perform a draw die process, the probability associated with the unique combination can be updated based on whether the draw die process was successful or unsuccessful.

It is appreciated in some embodiments, the probability of a successful draw die process using a particular combination of press parameters and mechanical properties, e.g., $P(w_1(x))$, is based on:

$$P_1(x/w_1)P(w_1)$$

where $w_1$ is a synaptic weight vector which can be initially determined during the experimental phase described above, and x is a vector $$\begin{bmatrix} x_1 \\ x_2 \\ x_d \end{bmatrix}.$$

$x_1$ is the lubrication parameter value, $x_2$ is the cushion tonnage parameter value, and $x_d$ is the set of mechanical properties. While $w_1$ is originally calculated during the experimental phase, $w_1$ can be adjusted each time a draw die process is performed using the press parameter combination defined in x. It is appreciated that the probability can be calculated in any other suitable manner. The probability can increase or decrease as data is collected, and the neural network can be further optimized to increase the probability of successful draw die processes. The neural network can provide a continuous feedback loop to ensure that the draw die process converges on the mean of the upper and lower control limit, as defined above.

Figure 6:
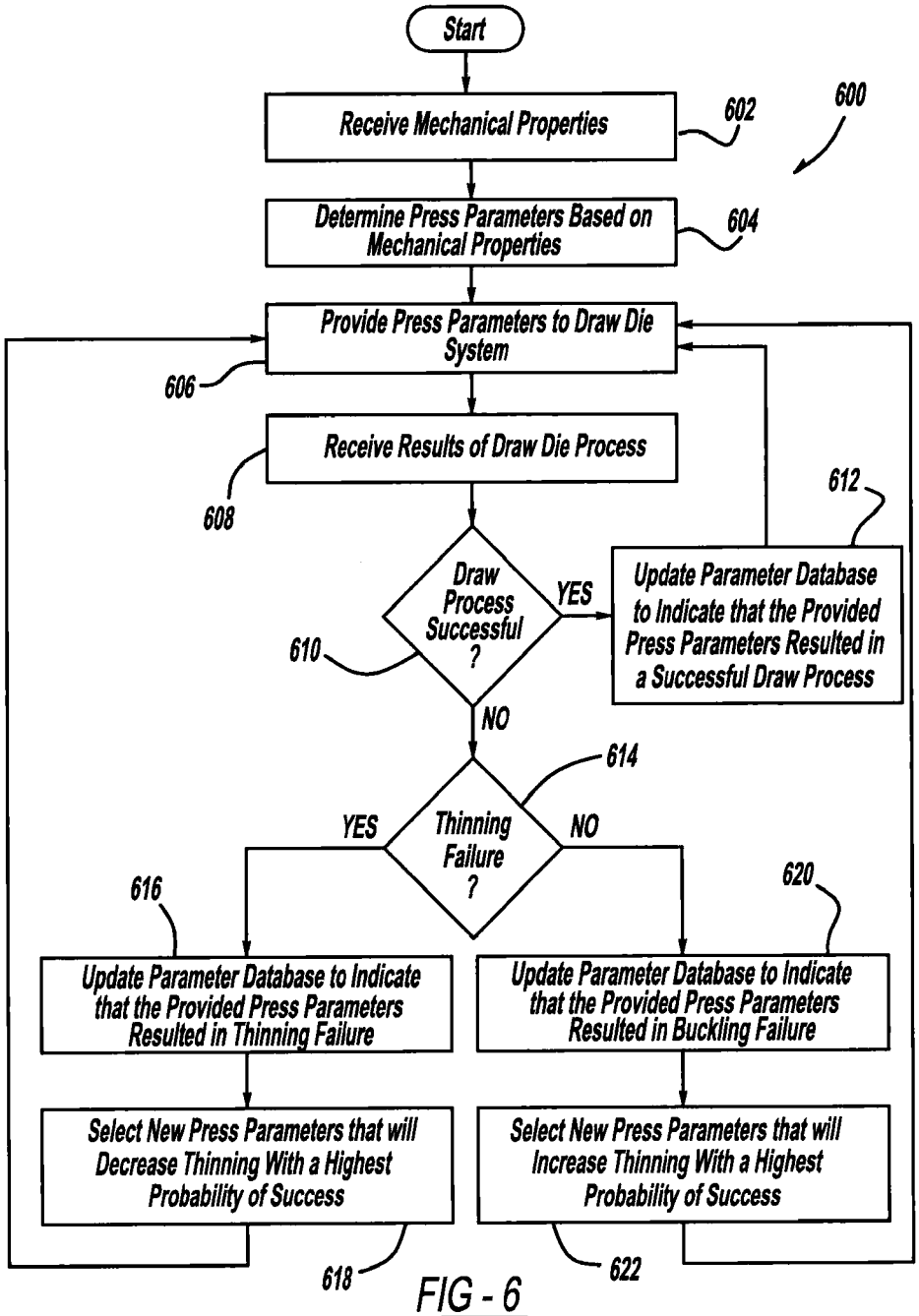
FIG. 6 is a flow chart illustrating a method for selecting a combination of press parameter combinations and updating a probability of a selected combination based on results of a draw die process performed using the combination of press parameter combinations.

FIG. 6 illustrates an exemplary method 600 for determining press parameters for forming a set of blanks 102 with a feedback loop. The method 600 begins after there has been sufficient training data stored in the parameter database 204. As can be appreciated, the training data can be obtained by performing controlled experiments, as described above, for a predetermined amount of blanks 102 using different combinations of press parameters. At step 602, the parameter determination module 202 receives a set of mechanical properties of a set of blanks 102. As can be appreciated, the set of blanks 102 are fed to the draw die system 100 individually and consecutively. As previously indicated, the mechanical properties of the set of blanks 102 may include ranges of material thickness and ranges of n-values of the set of blanks 102. The mechanical properties may further include ranges of yield strength, tensile strength, and elongation.

Upon receiving the mechanical properties of the set of blanks 102, the parameter determination module 202 retrieves press parameters based on the mechanical properties from the parameter database 204. As can be appreciated, for each set of mechanical properties, there is at least one set of corresponding press parameters, i.e., a lubrication parameter value and a cushion tonnage parameter value, wherein each press parameter combination has a probability associated therewith. As discussed above, the probability of a press parameter combination will be a probability of a successful draw die process or alternatively a probability of a failed draw die process. If more than one press parameter combination corresponds to a set of mechanical properties, the parameter determination module 202 can select the press parameter combination with the highest probability of a successful draw die process.

The parameter determination module 202 communicates a signal to the draw die system 100 indicating the press parameter combination, i.e., the determined lubrication parameter value and the determined cushion tonnage parameter value, as shown at step 606. The parameter determination module 202 further provides the press parameter combination to the feedback module 206, so that the feedback module 206 can update the parameter database 204 based on the results of the draw die process.

Upon performing the draw die process, the sensor 210 measures thinning at one or more critical areas of the drawn blank 102 and provides thinning data, i.e., the measured thinning at the critical areas, to the feedback module 206. In some embodiments, a profilometer may be used to determine whether the blank is insufficiently thinned or excessively thinned. Alternatively, a user may provide input to draw die system 100 pertaining to whether there was any observed buckling in the drawn blank 102. The results of the draw die process of a drawn blank 102 are received by the feedback module 206, as shown at step 608. Further, as described above, the feedback module 206 receives the press parameter combination used during the draw die process used to press the drawn blank 102. Based on the results, the feedback module 206 determines whether the draw die process resulted in failure or success, as shown at step 610. For instance, the feedback module 206 may compare the results with the upper limit 410 of the FLC 400 corresponding to the mechanical properties of the drawn blank 102. Further, the feedback module 206 may compare the results with the lower limit 420 of the FLC to determine if insufficient thinning has occurred.

If the results indicate a successful draw die process, e.g., acceptable amounts of thinning, then the feedback module 206 affirms the press parameter combination used to perform the draw die process on the successfully drawn blank 102 given the mechanical properties of the blank 102, as shown at step 612. For instance, the feedback module 206 records the results of the draw die process in the class p, such that the press parameter combination and mechanical properties corresponding to the performed draw die process are acknowledged as producing a successful draw. By adding the press parameter combination to the class p, the probability associated with the press parameter combination used to perform the draw die process and the mechanical properties corresponding to the drawn blank 102 are updated. When a successful draw die process is performed using a press parameter combination, the press parameter combination is fed back to the parameter determination module 202 and the process is repeated for a next blank 102.

If, however, the feedback module 206 determines that the draw die process resulted in a failed draw, the feedback module 206 determines the type of failure, as shown at step 614. As should be appreciated, the types of failure are excessive thinning and insufficient thinning. If the failure is due to excessive thinning, the feedback module 206 updates the parameter database 204 to indicate that the provided press parameter combination resulted in excessive thinning, as shown at step 616. If the failure is due to insufficient thinning, the feedback module 206 updates the parameter database 204 to indicate that the provided press parameter combination resulted in an insufficient thinning failure. In some embodiments, the feedback module 206 includes the provided press parameter combination and the mechanical properties that resulted in failure to the class q. By adding the press parameter combination to the class q, the probability associated with the press parameter combination used to perform the draw die process and the mechanical properties corresponding to the drawn blank 102 are updated to indicate a reduced probability of success.

In the event of failure due to excessive thinning, the feedback module 206 will notify the parameter determination module 202 that the provided press parameter combination resulted in a thinning failure. The parameter determination module 202, in response to receiving notification that the provided press parameter resulted in thinning failure, can select a new press parameter combination that has the highest probability of success and will reduce thinning, as shown at step 618. It should be appreciated that to reduce thinning, the parameter determination module 202 can increase the amount of lubrication and/or reduce the cushion tonnage. The parameter determination module 202 will select a press parameter combination that has either an increased lubrication parameter value in relation to the previous lubrication parameter value, a decreased cushion tonnage parameter value in relation to the previous cushion tonnage parameter value, or both an increased lubrication parameter value and a decreased cushion tonnage parameter value. As there may be many combinations of press parameters that will reduce thinning stored in the parameter database 204, the parameter determination module 202 will select a new press parameter combination that has the highest probability of success associated therewith.

Furthermore, in some embodiments, if there is not a press parameter combination that is likely to decrease thinning and result in a successful draw-die process, the parameter determination module 202 can generate the new press parameter combination by decrementing the cushion tonnage parameter value and/or incrementing the lubrication parameter value. The generated press parameter combination can be included in the parameter database 204 and a probability of success can be maintained for the generated press parameter combination. Whether retrieved or generated, the new press parameter combination is provided to the die draw system 100, and the process described above is repeated for the next blank 102.

In the event of failure due to insufficient thinning, the feedback module 206 will notify the parameter determination module 202 that the provided press parameter combination resulted in an insufficient thinning failure. The parameter determination module 202, in response to receiving notification that the provided press parameter resulted in insufficient thinning failure, can select a new press parameter combination that has the highest probability of success and will increase thinning, thereby avoiding insufficient thinning.

It should be appreciated that to increase thinning, the parameter determination module 202 can decrease the amount of lubrication and/or increase the cushion tonnage. The parameter determination module 202 can select a press parameter combination that has either a decreased lubrication parameter value in relation to the previous lubrication parameter value, an increased cushion tonnage parameter value in relation to the previous cushion tonnage parameter value, or both an decreased lubrication parameter value and an increased cushion tonnage parameter value. As there may be many combinations of press parameters that can increase thinning stored in the parameter database 204, the parameter determination module 202 can select a combination of new press parameters that has the highest probability of success associated therewith. Furthermore, in some embodiments, if there is not a press parameter combination that is likely to increase thinning and result in a successful draw-die process, the parameter determination module 202 can generate the new press parameter combination by incrementing the cushion tonnage parameter value and/or decrementing the lubrication parameter value. The generated press parameter combination can be included in the parameter database 204 and a probability of success can be maintained for the generated press parameter combination. Whether retrieved or generated, the new press parameter combination is provided to the die draw system 100, and the process described above is repeated for the next blank 102.

It is appreciated that the method 600 may execute continuously until the entire set of blanks 102 has been processed. Because the feedback loop continuously updates the parameter database 204, the dataset on which the parameter determination module 202 uses to select the press parameters is continuously increasing in richness. It is appreciated, that the foregoing method 600 is one implementation of a neural network and that other implementations of neural networks are contemplated and can be implemented by the feedback module. Further, it is appreciated that variations of the method 600 are within the scope of the disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code, or a process executed by a distributed network of processors and storage in networked clusters or datacenters; other suitable components that provide the described functionality; or a combination of some or all of the above, such as in a system-on-chip. The term module may include memory (shared, dedicated, or group) that stores code executed by the one or more processors.

The term code, as used above, may include software, firmware, bytecode and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A control module that controls a draw die process comprising:

a press parameter database stored in memory that contains a plurality of press parameter combinations corresponding to a plurality of different mechanical properties of materials, wherein each one of the plurality of different mechanical properties has at least one press parameter combination corresponding thereto, and wherein each specific press parameter combination of the plurality of press parameter combinations has associated therewith a probability of one of a successful draw die process and a failed draw die process given the specific press parameter combination and the one of the different mechanical properties corresponding to the specific press parameter combination;

a parameter determination module that receives mechanical properties corresponding to a plurality of blanks that are to undergo the draw die process, retrieves a press parameter combination based on the received mechanical properties and a probability associated with the retrieved press parameter combination, the probability being indicative of a likelihood of one of a successful draw die process and a failed draw die process given the retrieved press parameter combination and the received mechanical properties, and provides the retrieved press parameter combination to a draw die system that performs a first draw die process on a first blank from the plurality of blanks; and a feedback module that receives a result of the first draw die process, determines whether the first draw die process resulted in failure or in success, and adjusts the probability associated with the retrieved press parameter combination based on whether the first draw die process resulted in failure or in success.

2. The system of claim 1 wherein the press parameter determination module retrieves the retrieved press parameter combination based on the probability of the retrieved press parameter combination and other probabilities associated to other press parameter combinations that correspond to the received mechanical properties, each one of the other probabilities being indicative of a likelihood of one of a successful draw die process and a failed draw die process given the retrieved press parameter combination associated with the other probability and the received mechanical properties.

3. The system of claim 2 wherein each press parameter combination includes a lubrication parameter value indicating a thickness of lubrication to apply to a blank and a cushion tonnage parameter value indicating a cushion tonnage setting for the draw die system.

4. The system of claim 3 wherein when the feedback module determines that the first draw die process resulted in failure, the feedback module determines whether the failure was caused by excessive thinning or insufficient thinning, and wherein the parameter determination module retrieves a new press parameter combination of the plurality of press parameter combinations that is most likely to result in a successful draw die process.

5. The system of claim 4 wherein when the feedback module determines that the failure was caused by thinning, the parameter determination module retrieves a new press parameter combination for a second draw die process having at least one of an increased lubrication parameter value in relation to the lubrication parameter value of the retrieved press parameter combination and a decreased cushion tonnage parameter value in relation to the cushion tonnage parameter value of the retrieved press parameter combination, wherein the new press parameter combination is selected based on the probability associated thereto.

6. The system of claim 4 wherein when the feedback module determines that the failure was caused by insufficient thinning, the parameter determination module retrieves a new press parameter combination for a second draw die process having at least one of a decreased lubrication parameter value in relation to the lubrication parameter value of the retrieved press parameter combination and an increased cushion tonnage parameter value in relation to the cushion tonnage parameter value of the retrieved press parameter combination, wherein the new press parameter combination is selected based on the probability associated thereto.

7. The system of claim 1 wherein the feedback module receives results for each performed draw die process, each draw die process being performed according to a particular press parameter combination, and updates the probability of each particular press parameter combination based on the results of each performed draw die process.

8. The system of claim 1 further comprising a parameter initialization module that performs an experimental phase of draw die processes corresponding to the plurality of different mechanical properties, the experimental phase comprising a predetermined amount of draw die processes performed at different predefined combinations of press parameter combinations wherein experimental results from each draw die process of the experimental phase are recorded.

9. The system of claim 8 wherein the plurality of press parameter combinations stored in the parameter database are initially determined by the parameter initialization module and are updated by the feedback module after each performed draw die process.

10. The system of claim 1 wherein the feedback module implements a neural network that uses mechanical properties and corresponding press parameter combinations as input variables and results as an output variable.

11. A method for controlling a draw die process comprising:

storing a plurality of press parameter combinations corresponding to a plurality of different mechanical properties of materials in a parameter database, wherein each one of the plurality of different mechanical properties has at least one press parameter combination corresponding thereto, and wherein each specific press parameter combination of the plurality of press parameter combinations has associated thereto a probability of one of a successful draw die process and a failed draw die process given the specific press parameter combination and the one of the different mechanical properties corresponding to the specific press parameter combination;

receiving mechanical properties corresponding to a plurality of blanks that are to undergo the draw die process;

retrieving a press parameter combination based on the received mechanical properties and a probability associated with the retrieved press parameter combination, the probability being indicative of a likelihood of one of a successful draw die process and a failed draw die process given the retrieved press parameter combination and the received mechanical properties;

providing the retrieved press parameter combination to a draw die system that performs a first draw die process on a first blank from the plurality of blanks;

receiving a result of the first draw die process;

determining whether the first draw die process resulted in failure or in success; and adjusting the probability associated to the retrieved press parameter combination based on whether the first draw die process resulted in failure or in success.

12. The method of claim 11 wherein retrieving the press parameter combination further comprises retrieving the retrieved press parameter combination based on the probability of the retrieved press parameter combination and other probabilities associated to other press parameter combinations that correspond to the received mechanical properties, each one of the other probabilities being indicative of a likelihood of one of a successful draw die process and a failed draw die process given the retrieved press parameter combination associated with the other probability and the received mechanical properties.

13. The method of claim 12 wherein each press parameter combination includes a lubrication parameter value indicating a thickness of lubrication to apply to a blank and a cushion tonnage parameter value indicating a cushion tonnage setting for the draw die system.

14. The method of claim 13 further comprising:

when the first draw die process results in failure, determining whether the failure was caused by excessive thinning or insufficient thinning, and retrieving a new press parameter combination from the parameter database that is most likely to result in a successful second draw die process.

15. The method of claim 14 wherein when the failure was caused by thinning the method the new press parameter combination for the second draw die process includes at least one of an increased lubrication parameter value in relation to the lubrication parameter value of the retrieved press parameter combination and a decreased cushion tonnage parameter value in relation to the cushion tonnage parameter value of the retrieved press parameter combination, wherein the new press parameter combination is selected based on a probability associated thereto.

16. The method of claim 14 wherein when the failure was caused by insufficient thinning, the new press parameter combination for the second draw die process includes at least one of a decreased lubrication parameter value in relation to the lubrication parameter value of the retrieved press parameter combination and an increased cushion tonnage parameter value in relation to the cushion tonnage parameter value of the retrieved press parameter combination, wherein the new press parameter combination is selected based on a probability associated thereto.

17. The method of claim 11 further comprising receiving results for each performed draw die process, each draw die process being performed according to a particular press parameter combination, and updating the probability of each particular press parameter combination based on the results of each performed draw die process.

18. The method of claim 11 further comprising performing an experimental phase of draw die processes corresponding to the plurality of different mechanical properties, the experimental phase comprising performing a predetermined amount of draw die processes at different predefined press parameter combinations, and recording experimental results from each draw die process of the experimental phase.

19. The method of claim 18 wherein the plurality of press parameter combinations stored in the parameter database are initially determined during the experimental phase and are updated after each performed draw die process.

20. The method of claim 11 further comprising implementing a neural network that uses mechanical properties and corresponding press parameter combinations as input variables and results as an output variable.

* * * * *